US008257196B1

(12) United States Patent
Abbott et al.

(10) Patent No.: US 8,257,196 B1
(45) **Date of Patent: *Sep. 4, 2012**

(54) CUSTOMIZABLE GOLF CLUB HEAD

(75) Inventors: Craig E. Abbott, Vista, CA (US); Catherine Brookshire, Escondido, CA (US); Tim Goudarzi, San Marcos, CA (US); Scott Manwaring, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/451,347

(22) Filed: Apr. 19, 2012

Related U.S. Application Data

(63) Continuation of application No. 13/407,424, filed on Feb. 28, 2012.

(51) Int. Cl.
*A63B 53/04* (2006.01)
*A63B 53/06* (2006.01)

(52) U.S. Cl. ..... 473/335; 473/338; 473/345; 473/349

(58) Field of Classification Search ..... 473/324–350, 473/287–292, 256
See application file for complete search history.

(56) References Cited

U.S. PATENT DOCUMENTS

| | | | | |
|---|---|---|---|---|
| 4,052,075 | A * | 10/1977 | Daly | 473/338 |
| 4,423,874 | A * | 1/1984 | Stuff, Jr. | 473/338 |
| 4,795,159 | A * | 1/1989 | Nagamoto | 473/338 |
| 5,316,305 | A * | 5/1994 | McCabe | 473/332 |
| 5,571,053 | A * | 11/1996 | Lane | 473/336 |
| 6,773,360 | B2 * | 8/2004 | Willett et al. | 473/334 |
| 7,121,956 | B2 * | 10/2006 | Lo | 473/335 |
| 7,166,040 | B2 * | 1/2007 | Hoffman et al. | 473/334 |
| 7,410,426 | B2 * | 8/2008 | Willett et al. | 473/334 |
| 7,628,711 | B2 * | 12/2009 | Akinori et al. | 473/335 |
| 8,197,357 | B1 * | 6/2012 | Rice et al. | 473/334 |
| 8,197,358 | B1 * | 6/2012 | Watson et al. | 473/334 |

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A golf club having features that permit easy customization by consumers is disclosed herein. The golf club includes at least one weight port, a ribbon, at least one removable weight port ring, and at least one removable ribbon insert.

19 Claims, 2 Drawing Sheets

CUSTOMIZABLE GOLF CLUB HEAD

CROSS REFERENCES TO RELATED APPLICATIONS

The present application is a continuation of U.S. patent application Ser. No. 13/407,424, filed on Mar. 19, 2012, the disclosure of which is hereby incorporated by reference herein in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having features that can be adjusted by golfers to customize the golf club head to better suit their tastes or weighting needs, or to improve the visibility of the golf club on a golf course. More specifically, the present invention relates to a golf club head having a replaceable ribbon band and one or more replaceable weight port rings that can be exchanged for other ribbon bands and weight port rings.

2. Description of the Related Art

Customization of consumer products in general, and golf club equipment in particular, has become more popular in recent years. Manufacturers are seeking new ways to design golf clubs and golf balls that appeal to the individualized tastes of their consumers. These manufacturers may offer golf equipment in different colors or designs, but once the customer purchases his or her equipment, no further customization is possible without a significant expenditure of time, expense, and expertise. As such, there is a need for a golf club head having features that permit golfers to easily customize various qualities of the golf club head.

BRIEF SUMMARY OF THE INVENTION

The present invention relates to an easily customizable golf club head. One aspect of the present invention is a golf club head comprising a sole comprising at least one weight port, a ribbon comprising at least one elongate recess, at least one weight port ring, and at least one elongate insert, wherein the at least one weight port ring fits within the at least one weight port, and wherein the at least one elongate insert fits within the at least one elongate recess.

In some embodiments, the at least one weight port ring and the at least one elongate insert may be composed of a lightweight material. The at least one weight port ring may be retained within the at least one weight port with an adhesive material, and the at least one elongate insert may also be retained within the at least one elongate recess with an adhesive material, which may be semi-permanent. In further embodiments, the at least one weight port ring may be removably received within the at least one weight port, and the at least one elongate insert may also be removably received within the at least one elongate recess. The elongate recess may be disposed in an aft region of the ribbon, and the sole may comprise two weight ports and one elongate recess. In a further embodiment, the golf club head may comprise at least one weight screw, wherein the at least one weight screw is received within the at least one weight port, and wherein the weight port ring is disposed between the sides of the weight port and the weight screw.

Another aspect of the present invention is a driver-type golf club head comprising a face, a crown, a sole comprising at least one weight port, the at least one weight port comprising a shallow recess and a threaded bore, a ribbon connecting the crown to the sole, the ribbon comprising an aft region having an elongate recess, at least one weight screw comprising a head and a threaded extension, the head sized to fit within the shallow recess, and the threaded extension sized to fit within the threaded bore, at least one weight port ring sized to fit within the weight port recess, and an elongate insert sized to fit within the elongate recess, wherein the at least one weight port ring and the elongate insert are composed of a lightweight material, wherein the at least one weight port ring is removably affixed within the weight port recess with a semi-permanent adhesive material, wherein the elongate insert is removably affixed within the elongate recess with a semi-permanent adhesive material, and wherein the at least one weight port ring is disposed between at least one wall of the shallow recess and the head of the weight screw.

In some embodiments, the at least one weight port ring may comprise a cylindrical wall and a shelf portion disposed perpendicular to the cylindrical wall, the shelf portion rests against a bottom surface of the at least one weight port, and the cylindrical wall rests against a side surface of the at least one weight port. In these embodiments, the adhesive material may be disposed on an external surface of the cylindrical wall and a lower surface of the shelf portion. In other embodiments, the at least one weight screw may not make contact with any portion of the at least one weight port ring. In yet other embodiments, the at least one weight port ring and the elongate insert may each be composed of a polymeric material, and the at least one weight screw may be composed of at least one metal material.

Yet another aspect of the present invention is a kit comprising a golf club head comprising a sole, a ribbon, a crown, and a face, at least one shallow recess disposed on at least one of the sole, ribbon, and crown, and a plurality of inserts sized to fit within the at least one shallow recess, wherein each of the plurality of inserts has a color that differs from the color of the other inserts, and wherein each of the plurality of inserts is composed of a lightweight material. Each of the plurality of inserts may have an external surface comprising a semi-permanent adhesive material, and may have a density that differs from the density of the other inserts. In some embodiments, the at least one shallow recess may be a weight port and the plurality of inserts may weight port rings, which may be a polymeric material. In other embodiments, the at least one shallow recess may be an aft ribbon elongate recess and the plurality of inserts may be elongate inserts sized to fit within the elongate recess and may be composed of a polymeric material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
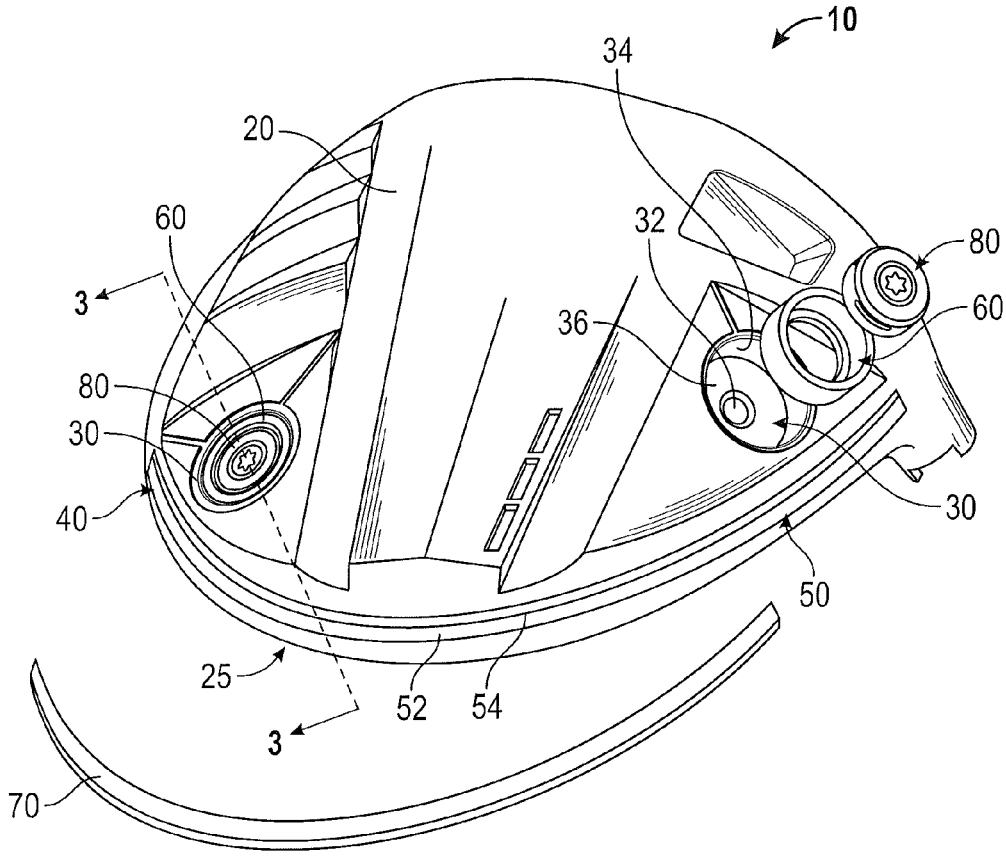
FIG. 1 is an exploded view of the preferred embodiment of the present invention.

The present invention allows golfers to customize features of their golf club heads using replaceable parts. The replaceable parts may have different visual features, such as coloration or design, or may have different weights or densities. The embodiments of the present invention may be used with any type of golf club head, including woods, hybrids, irons, and putters, though in the preferred embodiment the present invention is used in connection with a driver head 10 having a face (not shown), a crown (not shown), a sole 20, an aft end 25, one or more weight ports 30, and a ribbon or side edge 40 connecting the crown to the sole 20. The embodiments of the present invention may be provided to consumers as a kit, which may comprise a golf club head and numerous different customizable parts having different colors, features, weights, densities, and/or material compositions.

A preferred embodiment of the present invention is shown in FIGS. 1-4. A driver head 10 has two weight ports 30 in its sole 20 and an elongate, shallow recess 50 in an aft region 25 of its ribbon 40. Each weight port 30 includes a threaded bore 32, a side wall 34, and a base 36, and receives a weight screw 80 having a head 82 sized to fit within the weight port 30 and a threaded extension 84 sized to removably engage the threads of the threaded bore 32.

Figure 2:
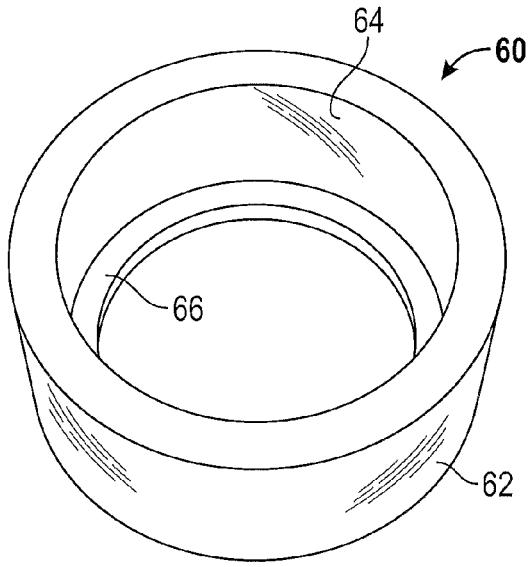
FIG. 2 is an enlarged view of the weight port ring shown in FIG. 1.
Figure 3:
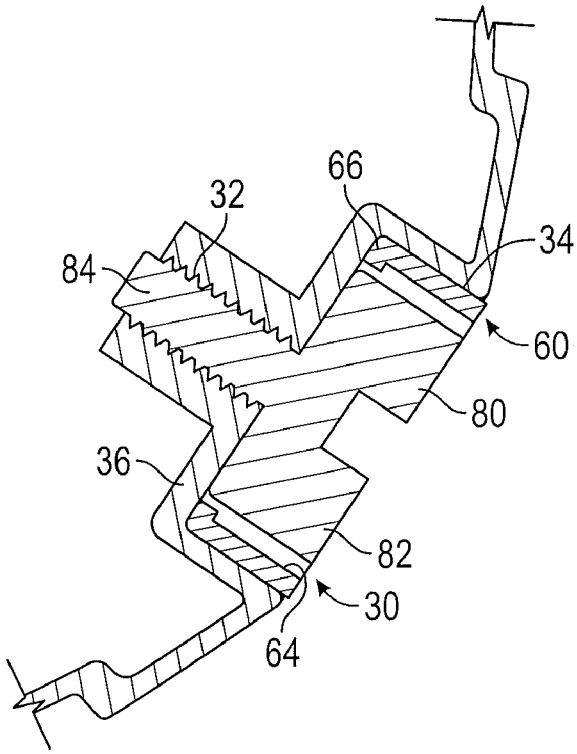
FIG. 3 is a cross-section view of the embodiment shown in FIG. 1 along lines 3-3.
Figure 4:
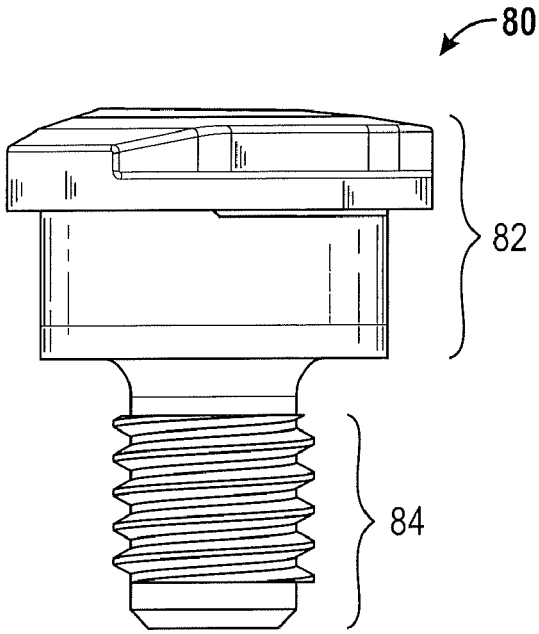
FIG. 4 is a side view of the weight screw shown in FIG. 1.

In addition to the weight screw 80, the weight port 30 is sized to receive a weight port ring 60, which preferably sits between the side wall 34 and the head 82 of the weight screw 80 without making contact with any portion of the weight screw 80. As shown in FIGS. 1, 2, and 3, the weight port ring 60 includes an exterior wall 64, which rests against the interior wall 34 of the weight port 30, an interior wall 62 that is preferably spaced from the weight screw 80 when the screw 80 is assembled in the weight port 30, and a shelf 66 that rests against the base 36 of the weight port 30. In the preferred embodiment, the weight port ring 60 can be removed and replaced with a weight port ring 60 having different cosmetic features, different material compositions, different weights, or a combination of these elements. The exterior wall 64 of the weight port ring 60 thus preferably is coated with a semi-permanent adhesive material that allows the weight port ring 60 to semi-permanently bond with the interior wall 34 of the weight port 30, but permits removal of the weight port ring 60 from the weight port 30 if enough force is applied.

The shallow recess 50 also has side walls 52 and a base 54, and is sized to receive an elongate ribbon insert 70, which preferably is removably fixed within the shallow recess 50. As described herein with respect to the weight port ring 60, at least one surface of the ribbon insert 70 is coated with a semi-permanent adhesive material that permits the ribbon insert to semi-permanently bond with the side walls 52 and/or base 54 of the shallow recess. Also, as with the weight port ring 60, the elongate ribbon insert 70 preferably can be removed and replaced with a ribbon insert 70 having different cosmetic features, different material compositions, different weights, or a combination of these elements.

In the preferred embodiment, the sole 20 is composed of a metal alloy material, and the weight ports 30 are integrally formed in the sole. In alternative embodiments, the sole 20, including the weight ports 30, may be composed of a composite material, and have the structure and composition of one or more of the embodiments disclosed in U.S. patent application Ser. Nos. 13/248,855 and 13/363,551, the disclosure of each of which is hereby incorporated by reference in its entirety herein. The weight screws 80 preferably are formed of a single type of metal material, but in alternative embodiments may have any structure or material composition, including those disclosed in U.S. Provisional Patent Application No. 61/496,695, the disclosure of which is hereby incorporated by reference in its entirety herein.

The embodiments disclosed herein may be made of any number of materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein. For example, in some embodiments, the head 10 may be integrally cast from a metal alloy such as titanium. In other embodiments, only the sole, face, and ribbon are composed of a metal alloy and the crown is formed of a composite material. The other pieces of the invention may also be composed of any kind of material. For example, the weight port ring 60 and the ribbon insert 70 may be made of a lightweight metal alloy, a polymeric material such as plastic or rubber, and/or a composite material. In alternative embodiments, these pieces may be composed of one or more metal alloys.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face component;

a crown;

a sole comprising at least one weight port;

at least one weight port ring comprising a lightweight material; and at least one weight screw comprising a metal material, wherein the at least one weight port comprises a threaded bore, a side wall, and a base, wherein the at least one weight port ring is affixed within the at least one weight port with an adhesive material, wherein the at least one weight screw is received within the at least one weight port, wherein at least part of the weight port ring is disposed between the weight port and the weight screw, and wherein the at least one weight port ring does not make contact with the weight screw when the weight port ring and the weight screw are disposed within the weight port.

2. The golf club head of claim 1, wherein the at least one weight port ring is composed of a non-metal material.

3. The golf club head of claim 2, wherein the at least one weight port ring is composed of a material selected from the group consisting of rubber, plastic, and composite.

4. The golf club head of claim 3, wherein the at least one weight port ring is composed of plastic.

5. The golf club head of claim 1, wherein the at least one weight port ring comprises an exterior wall and a shelf, wherein the exterior wall rests against the side wall of the weight port, and wherein the shelf rests against the base of the weight port.

6. The golf club head of claim 1, wherein the weight screw comprises a head sized to fit within the weight port and a threaded extension sized to removably engage the threaded bore.

7. The golf club head of claim 1, wherein the golf club head is a driver-type head having a volume of 300 to 500 cubic centimeters.

8. The golf club head of claim 1, wherein the adhesive material is semi-permanent, and wherein the at least one weight port ring is removably received within the at least one weight port.

9. The golf club head of claim 1, wherein the sole comprises two weight ports.

10. The golf club head of claim 1, wherein the sole and face component are composed of a metal material, and wherein the crown is composed of a composite material.

11. The golf club head of claim 10, wherein the metal material is titanium alloy.

12. The golf club head of claim 1, wherein the sole is composed of a composite material.

13. The golf club head of claim 12, wherein the at least one weight port is integrally formed in the sole.

14. A driver-type golf club head comprising:

a body portion cast from a titanium alloy, the body portion comprising a face component and a sole;

a composite crown;

at least one weight screw comprising a head and a threaded extension; and at least one weight port ring composed of a polymeric material, wherein the sole comprises at least one, integrally formed weight port, wherein the at least one weight port comprises a shallow recess having a base and a side wall, and a threaded bore, wherein the screw head is sized to fit within the shallow recess, and wherein the threaded extension of the screw is sized to removably engage the threaded bore, wherein the at least one weight port ring is sized to fit within the weight port recess, wherein the at least one weight port ring is affixed within the weight port recess with an adhesive material, wherein the at least one weight port ring is disposed between at least one wall of the shallow recess and the head of the weight screw, and wherein the at least one weight screw does not make contact with any portion of the at least one weight port ring.

15. The driver-type golf club head of claim 14, wherein the at least one weight port ring comprises a cylindrical wall and a shelf portion disposed perpendicular to the cylindrical wall, wherein the shelf portion rests against the base of the at least one weight port, and wherein the cylindrical wall rests against the side wall of the at least one weight port.

16. The driver-type golf club head of claim 15, wherein the adhesive material is disposed on an external surface of the cylindrical wall and a lower surface of the shelf portion.

17. The driver-type golf club head of claim 14, wherein the at least one weight port ring is composed of a plastic material.

18. The driver-type golf club head of claim 14, wherein the adhesive is semi-permanent and wherein the at least one weight port ring is removably affixed within the at least one weight port.

19. The driver-type golf club head of claim 14, wherein the sole comprises two, integrally formed weight ports, wherein the at least one weight screw comprises two weight screws, and wherein the at least one weight port ring comprises two weight port rings.

* * * * *